US010374307B2

(12) United States Patent
Ohkoshi et al.

(10) Patent No.: US 10,374,307 B2
(45) Date of Patent: Aug. 6, 2019

(54) HIGH-FREQUENCY ANTENNA ELEMENT AND HIGH-FREQUENCY ANTENNA MODULE

(71) Applicants: THE UNIVERSITY OF TOKYO, Tokyo (JP); TOKYO OHKA KOGYO CO., LTD., Kawasaki-shi (JP)

(72) Inventors: Shin-ichi Ohkoshi, Tokyo (JP); Asuka Namai, Tokyo (JP); Marie Yoshikiyo, Tokyo (JP); Takashi Ono, Kawasaki (JP)

(73) Assignees: THE UNIVERSITY OF TOKYO, Tokyo (JP); TOKYO OHKA KOGYO CO., LTD., Kawasaki-Shi (JP)

( * ) Notice: Subject to any disclaimer, the term of this patent is extended or adjusted under 35 U.S.C. 154(b) by 37 days.

(21) Appl. No.: 15/468,623

(22) Filed: Mar. 24, 2017

(65) Prior Publication Data

US 2017/0288305 A1 Oct. 5, 2017

(30) Foreign Application Priority Data

Mar. 31, 2016 (JP) ..... 2016-070963

(51) Int. Cl.

| | |
|---|---|
| ***H01Q 1/52*** | (2006.01) |
| ***H01Q 3/30*** | (2006.01) |
| ***H01Q 9/04*** | (2006.01) |
| ***H01Q 1/38*** | (2006.01) |
| ***H01Q 1/40*** | (2006.01) |
| *H01Q 1/22* | (2006.01) |
| *H01Q 1/36* | (2006.01) |

(52) U.S. Cl.

CPC ..... *H01Q 1/526* (2013.01); *H01Q 1/38* (2013.01); *H01Q 1/405* (2013.01); *H01Q 3/30* (2013.01); *H01Q 9/0407* (2013.01); *H01Q 1/2283* (2013.01); *H01Q 1/36* (2013.01)

(58) Field of Classification Search

CPC ..... H01Q 1/526; H01Q 1/52; H01Q 1/243; H01Q 1/38; H01Q 1/50

USPC ..... 343/841, 702, 872, 906

See application file for complete search history.

(56) References Cited

U.S. PATENT DOCUMENTS

2012/0044113 A1* 2/2012 Satoh ..... H01Q 1/06 343/702

2014/0145883 A1* 5/2014 Baks ..... H01Q 1/2283 343/700 MS

FOREIGN PATENT DOCUMENTS

JP 2009-060060 3/2009

* cited by examiner

*Primary Examiner* — Dameon E Levi
*Assistant Examiner* — Collin Dawkins
(74) *Attorney, Agent, or Firm* — Knobbe, Martens, Olson & Bear LLP

(57) ABSTRACT

A high-frequency antenna element that is easily downsized even when an electromagnetic wave absorber is used, and is capable of protecting a receiving antenna unit by covering the receiving antenna unit, and provides a high-frequency antenna module including the high-frequency antenna element. The high-frequency antenna element includes a substrate, a dielectric layer, a receiving antenna unit, and a coating layer, in which the dielectric layer is laminated on the substrate, the receiving antenna unit is mounted on the dielectric layer, the coating layer covers a surface of the dielectric layer in a portion in which the receiving antenna unit is not mounted while the coating layer is in contact with entire side surfaces of the receiving antenna unit, and the coating layer covers at least a part of an upper surface of the receiving antenna unit.

5 Claims, 3 Drawing Sheets

HIGH-FREQUENCY ANTENNA ELEMENT AND HIGH-FREQUENCY ANTENNA MODULE

This application claims priority to Japanese Patent Application No. 2016-070963, filed Mar. 31, 2016, the entire content of which is incorporated herein by reference.

BACKGROUND OF THE INVENTION

Field of the Invention

The present invention relates to a high-frequency antenna element and a high-frequency antenna module.

Related Art

Electromagnetic waves within a high frequency band are increasingly being used in various information communication systems such as cellular telephones, wireless LANs, ETC systems, intelligent transport systems, driving support road systems, satellite broadcasting, and the like. However, increasing use of electromagnetic waves within a high frequency band involves risk of failure and malfunction of electronic devices due to interference between electronic parts. In order to address such a problem, a method of absorbing unnecessary electromagnetic waves by an electromagnetic wave absorber has been employed.

Accordingly, in a radar or the like using electromagnetic waves within a high frequency band, electromagnetic wave absorbers have been used in order to reduce the influence of unnecessary electromagnetic waves that should not be received.

In order to accommodate such a demand, various electromagnetic wave absorbers capable of satisfactorily absorbing electromagnetic waves within a high frequency band have been proposed. Well-known specific examples thereof include a carbon nano-coil and a resin-containing electromagnetic wave absorbing sheet (see Patent Document 1).

Patent Document 1: Japanese Unexamined Patent Application, Publication No. 2009-060060

SUMMARY OF THE INVENTION

However, in various systems using electromagnetic waves within a high frequency band, when an electromagnetic wave absorber for absorbing electromagnetic waves within a high frequency band is disposed in contact with or in the vicinity of an antenna for receiving electromagnetic waves, the electromagnetic wave absorber absorbs also electromagnetic waves that should be received by the antenna. Consequently, a system cannot execute desired operations.

Therefore, in particular, a high-frequency antenna element provided with an electromagnetic wave absorber has problems in that downsizing is difficult or a receiving antenna unit cannot be protected.

The present invention has been made in view of the above described problems, and an object thereof is to provide a high-frequency antenna element that is easily downsized even when an electromagnetic wave absorber is used, and capable of protecting a receiving antenna unit by covering the receiving antenna unit, and to provide a high-frequency antenna module provided with the high-frequency antenna element.

The present inventors have completed the present invention by finding that the above described problems can be solved by configuring a high-frequency antenna element including a substrate, a dielectric layer, a receiving antenna unit, and a coating layer, in which the dielectric layer is laminated on the substrate, the receiving antenna unit is mounted on the dielectric layer, the coating layer covers a surface of the dielectric layer in a portion in which the receiving antenna unit is not mounted while the coating layer is in contact with entire side surfaces of the receiving antenna unit, and the coating layer covers at least a part of an upper surface of the receiving antenna unit.

A first aspect of the present invention relates to a high-frequency antenna element including a substrate, a dielectric layer, a receiving antenna unit, and a coating layer;

the dielectric layer is laminated on the substrate;

the receiving antenna unit is mounted on the dielectric layer; and the coating layer covers a surface of the dielectric layer in a portion in which the receiving antenna unit is not mounted while the coating layer is in contact with entire side surfaces of the receiving antenna unit, and the coating layer covers at least a part of an upper surface of the receiving antenna unit.

A second aspect of the present invention relates to a high-frequency antenna module including the high-frequency antenna element of the first aspect.

The present invention can provide a high-frequency antenna element, which is easily downsized even when an electromagnetic wave absorber is used, and which can protect a receiving antenna unit by covering the receiving antenna unit, and provide a high-frequency antenna module including the high-frequency antenna element.

DETAILED DESCRIPTION OF THE INVENTION

<<High-Frequency Antenna Element>>

Figure 1:
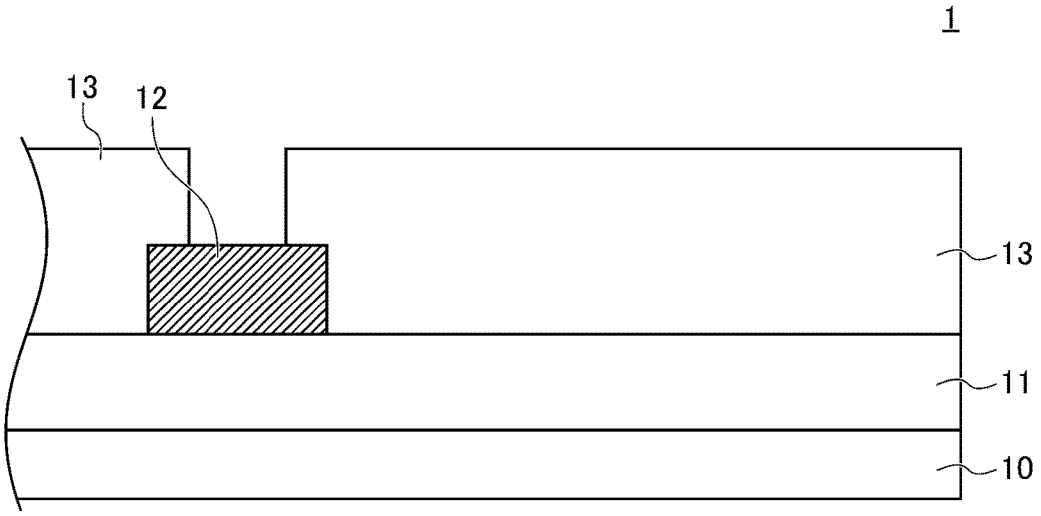
FIG. 1 is a view showing one example of an embodiment in which a coating layer covers a receiving antenna unit.

A high-frequency antenna element includes a substrate, a dielectric layer, a receiving antenna unit, and a coating layer.

The dielectric layer is laminated on the substrate.

The receiving antenna unit is mounted on the dielectric layer.

The coating layer covers a surface of the dielectric layer in a portion in which the receiving antenna unit is not mounted while the coating layer is in contact with entire side surfaces of the receiving antenna unit, and the coating layer covers at least a part of an upper surface of the receiving antenna unit.

The high-frequency antenna element having the above-mentioned configuration is easily downsized, even when an electromagnetic wave absorber is used; and since the receiving antenna unit is covered, the receiving antenna unit is favorably protected.

Hereinafter, members constituting the high-frequency antenna element will be described.

<Substrate>

A substrate 10 is a member for directly or indirectly supporting a dielectric layer 11, a receiving antenna unit 12, and a coating layer 13.

A material for the substrate 10 is not particularly limited, but is preferably a conductor from the viewpoint of electromagnetic wave reflectance properties. The type of the conductor is not particularly limited without interfering with the objective of the present invention, and is preferably metal. In a case in which the substrate 10 is composed of metal, the metal as the material for the substrate 10 is preferably aluminum, titanium, SUS, copper, brass, silver, gold, platinum, and the like.

The shape of the substrate 10 is not particularly limited, and various shapes can be employed. From the viewpoint of downsizing the high-frequency antenna element 1, a plate-like substrate 10 is selected in general. The plate-like substrate 10 may have a curved surface or be composed only of planar faces. The shape of the substrate 10 is preferably a flat plate shape, from the viewpoint of easy formation of the dielectric layer 12 and the coating layer 13 having uniform thickness.

When the substrate 10 is plate-like, the thickness thereof is not particularly limited. From the viewpoint of downsizing of the electromagnetic wave absorber, the thickness of the substrate 10 is preferably 0.1 μm to 5 cm.

<Dielectric Layer>

A dielectric layer 11 is a film made of a dielectric substance. The dielectric substance to be used for materials of the dielectric layer 11 can be appropriately selected from various dielectric substances that are used for the purpose of insulation and the like. Preferred examples of the dielectric substances include PTFE, a glass fiber-containing epoxy resin, and the like.

A thickness of the dielectric layer 11 is not particularly limited without impairing the objective of the present invention. The thickness of the dielectric layer 11 is typically preferably 0.050 mm to 4 mm, and more preferably 0.10 mm to 2 mm.

<Receiving Antenna Unit>

A receiving antenna unit 12 may be a circuit including metal wiring that functions as an antenna, or may be a so-called chip antenna in which the entire above-mentioned circuit functioning as an antenna is sealed.

The high-frequency antenna element 1 may be provided with two or more receiving antenna units 12 on the dielectric layer 11.

When the receiving antenna unit 12 is a circuit including metal wiring that functions as an antenna, a thickness of the metal wiring is only required to be thinner than a coating layer 13. The thickness is preferably thinner as far as the function of the antenna is not hindered.

Furthermore, the metal wiring that functions as the receiving antenna unit 12 is a patterned metal film in general. The pattern shape in this case is not particularly limited, and can be appropriately selected from shapes of circuits, which have been conventionally used as an antenna. Specific examples of the shapes include a spiral or meandering wiring shape.

Note here that when the receiving antenna unit 12 is patterned metal wiring, a coating layer 13 mentioned below is formed such that an entire side surface of the patterned metal wiring is brought into contact with the coating layer 13.

In this case, in metal wiring having a spiral or meandering shape, a space between adjacent metal wiring is preferably filled with the coating layer 13.

When the receiving antenna unit 12 is a chip antenna, the shape of the chip antenna is not particularly limited. It is preferable that the shape of the chip antenna is typically a flat plate shape having a pair of square or rectangular principal planes, a disk shape, or an elliptical disk shape.

The thickness of the chip antenna is only required to be thinner than the coating layer 13. The thickness is preferably thinner as far as the function of the antenna is not hindered. Note here that the thickness of the chip antenna is a thickness in the direction perpendicular to a principal plane of the substrate 10.

When an antenna module is formed by combining the high-frequency antenna element 1 and other parts, the receiving antenna unit 12 is generally connected to the other parts by wiring.

Therefore, in the high-frequency antenna element 1, it is preferable that terminals are provided on any sections of the surface of the high-frequency antenna element 1, and that wiring for connecting the terminals and the receiving antenna unit 12 is provided.

<Coating Layer>

The coating layer 13 covers a surface of the dielectric layer 11 in a portion in which the receiving antenna unit 12 is not mounted while the coating layer 13 is in contact with the entire side surfaces of the receiving antenna unit, and the coating layer 13 covers at least a part of an upper surface of the receiving antenna unit 12.

Thus, since the entire side surface and at least a part of the upper surface of the receiving antenna unit 12 are protected by the coating layer 13, the receiving antenna unit is less likely to undergo damage due to contact with other articles, corrosion due to corrosive gas and the like, thermic stimulation under harsh temperature conditions, and the like. Consequently, the high-frequency antenna element 1 having high operation reliability can be manufactured.

In order to completely protect the receiving antenna unit 12, it is preferable that the coating layer 13 covers the entire upper surface of the receiving antenna unit 12.

Figure 2:
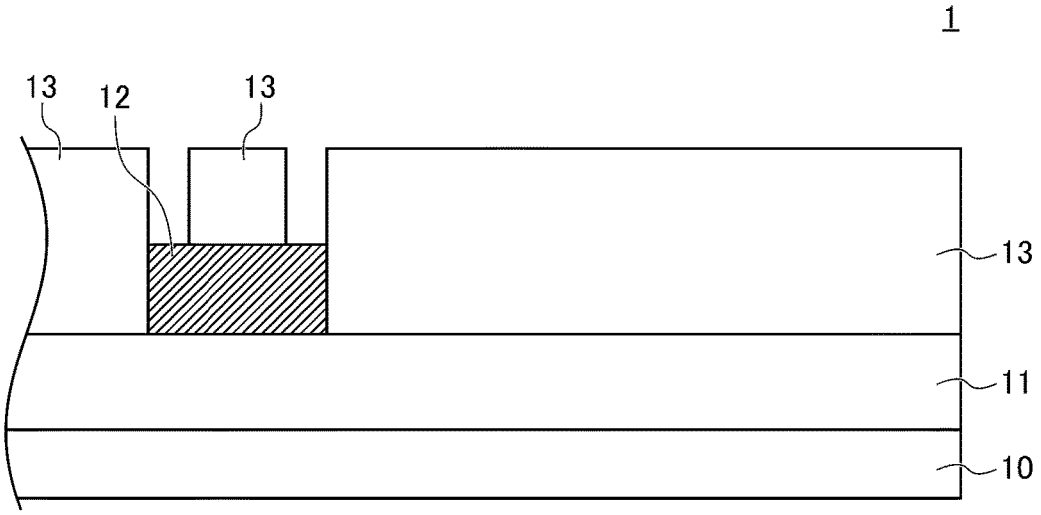
FIG. 2 is a view showing another example of the embodiment in which the coating layer covers the receiving antenna unit.
Figure 3:
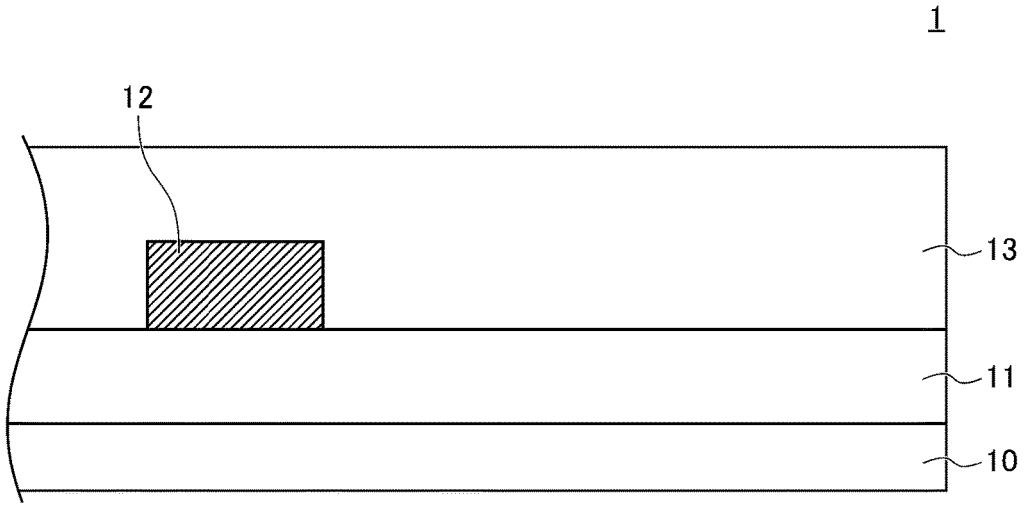
FIG. 3 is a view showing still another example of the embodiment in which the coating layer covers the receiving antenna unit.

FIGS. 1 to 3 are sectional views of the high-frequency antenna element 1 with respect to a surface perpendicular to the planer direction of the substrate 10, showing preferable embodiments of the coating layer 13, respectively.

FIG. 1 shows an embodiment in which the coating layer 13 covers a part of the upper surface of the receiving antenna unit 12. In this embodiment, the coating layer covers the peripheral portion of the upper surface of the receiving antenna unit 12, while not covering the middle portion of the upper surface of receiving antenna unit 12.

FIG. 2 shows an embodiment in which the coating layer 13 covers a part of the upper surface of the receiving antenna unit 12, showing an embodiment different from that shown in FIG. 1. In this embodiment, the coating layer does not cover the peripheral portion of the upper surface of the receiving antenna unit 12, while covering the middle portion of the upper surface of receiving antenna unit 12.

FIG. 3 shows a particularly preferable configuration. In this embodiment, the entire upper surface of the receiving antenna unit 12 is covered with the coating layer 13.

When the coating layer 13 covers the peripheral portion of the upper surface of the receiving antenna unit 12, and does not cover the middle portion of the upper surface, the coating layer may cover at least a part of the peripheral portion.

When the coating layer 13 does not cover the peripheral portion of the upper surface of the receiving antenna unit 12, and covers the middle portion of the upper surface, the middle portion may be covered with a single coating layer 13, or two or more separated coating layers 13.

A thickness of the coating layer 13 is not particularly limited as long as the receiving antenna unit 12 can be covered so as to satisfy the above-mentioned predetermined requirement. In other words, the thickness of the coating layer 13 is not particularly limited, as long as the thickness is larger than the thickness of the receiving antenna unit 12.

A thickness of the coating layer 13 in a portion covering the dielectric layer 11 is preferably 200 μm or less, and more preferably 150 μm or less. A thickness of the coating layer 13 in a portion covering the upper surface of the receiving antenna unit 12 is preferably 150 μm or less, and more preferably 100 μm or less.

The lower limit of the thickness of the coating layer is not particularly limited, but preferably at least 0.1 μm.

It is preferable that the coating layer 13 is a film capable of imparting electromagnetic wave absorbing properties to the high-frequency antenna element 1.

Note here that the "film capable of imparting electromagnetic wave absorbing properties to the high-frequency antenna element" is a film which imparts electromagnetic wave absorbing properties to the high-frequency antenna element as an entire high-frequency antenna element, and which does not attenuate an electromagnetic wave directly incident on the receiving antenna unit 12 to such a degree that the high-frequency antenna element 1 cannot execute a desired operation.

This is because, if a film that attenuates an electromagnetic wave directly incident on the receiving antenna unit 12 is employed, fundamentally, the function as an antenna element cannot be achieved.

It is preferable that the coating layer 13 does not excessively attenuate the electromagnetic waves directly incident on the receiving antenna unit 12, while attenuating electromagnetic waves reflected by an interface between the coating layer 13 and the dielectric layer 11 as well as an interface between the dielectric layer 11 and the substrate.

The electromagnetic wave directly incident on the receiving antenna unit 12 is an electromagnetic wave necessary for the high-frequency antenna element 1 to achieve a desired function. On the other hand, the electromagnetic waves reflected by the interface between the coating layer 13 and the dielectric layer 11 as well as the interface between the dielectric layer 11 and the substrate are, in essence, unnecessary electromagnetic waves that should not be incident on the receiving antenna unit 12.

The "film capable of imparting electromagnetic wave absorbing properties to the high-frequency antenna element" having the above-mentioned characteristics is not particularly limited, as long as the film is capable of attenuating electromagnetic waves other than the electromagnetic wave directly incident on the receiving antenna unit 12 by way of a mechanism mentioned below.

Preferable examples of the coating layer 13 that does not excessively attenuate the electromagnetic wave directly incident on the receiving antenna unit 12, while attenuating electromagnetic waves reflected by the interface between the coating layer 13 and the dielectric layer 11 as well as the interface between the dielectric layer 11 and the substrate include a film including specific epsilon-type iron oxide.

For such a coating layer 13 including the epsilon-type iron oxide, a film having relative permittivity of 6.5 to 65 is used.

Such a coating layer 13, when employed, can absorb an electromagnetic wave within a band of, for example, 60 to 270 GHz corresponding to the material composition or thickness of the coating layer 13.

Note here that, even if such a coating layer 13 is a thin film having a thickness of less than 1 mm, the high-frequency antenna element 1 exhibits excellent electromagnetic wave absorbing properties. Accordingly, when a film including specific epsilon iron oxide and exhibiting a predetermined relative permittivity is used as the coating layer 13, the high-frequency antenna element 1 is easily downsized.

Combination of the coating layer 13 satisfying such conditions with the above-mentioned substrate 10 and the dielectric layer 12 makes it possible to obtain a high-frequency antenna element 1 that can be applied to electromagnetic waves within a wide frequency band and can attenuate electromagnetic waves reflected by the interface between the coating layer 13 and the dielectric layer 11 as well as the interface between the dielectric layer 11 and the substrate 10.

Figure 4:
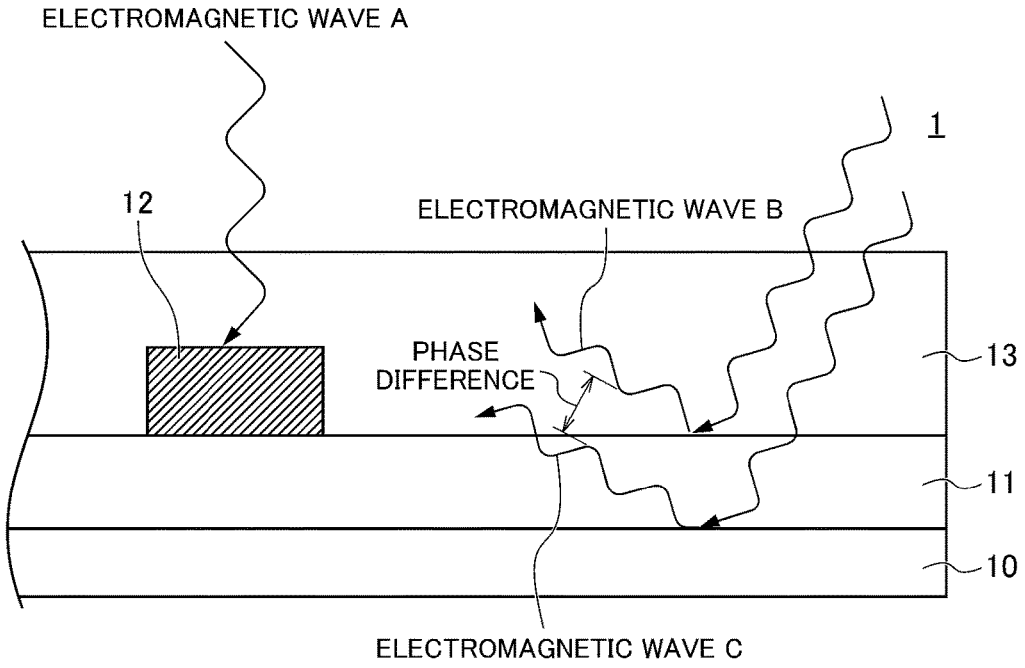
FIG. 4 is a view schematically showing a mechanism in which electromagnetic waves are attenuated by a substrate, a dielectric layer, and a coating layer.

The reason why the electromagnetic waves reflected by the interface between the coating layer 13 and the dielectric layer 11 as well as the interface between the dielectric layer 11 and the substrate 10 are attenuated by the above-mentioned coating layer 13 including epsilon-type iron oxide is schematically shown in FIG. 4.

Such a coating layer 13 hardly attenuates electromagnetic waves A incident on the coating layer 13.

Meanwhile, a phase difference occurs between an electromagnetic wave B reflected by the interface between the coating layer 13 and the dielectric layer 11, and an electromagnetic wave C reflected by the interface between the dielectric layer 11 and the substrate 10.

Specifically, the substrate 10 reflects electromagnetic waves that have passed through the coating layer 13 and the dielectric layer 11 among electromagnetic waves incident on the high-frequency antenna element 1. At the time, the substrate 10 changes a phase of the electromagnetic wave (the electromagnetic wave C) reflected by the interface between the substrate 10 and the dielectric layer 11 with respect to a phase of the electromagnetic wave incident on the interface between the substrate 10 and the dielectric layer 11.

Meanwhile, the phase of the electromagnetic wave (the electromagnetic wave B) reflected by the interface between the substrate 10 and the dielectric layer 11 is not largely changed with respect to the phase of the electromagnetic wave incident on the interface between the substrate 10 and the dielectric layer 11.

Thus, as shown in FIG. 4, the phase difference occurs between the electromagnetic wave (the electromagnetic wave C) reflected by the interface between the substrate 10 and the dielectric layer 11 and the electromagnetic wave (the electromagnetic wave B) reflected by the interface between the dielectric layer 11 and the coating layer 13.

As a result, the electromagnetic wave C reflected by the interface between the substrate 10 and the dielectric layer 11 and the electromagnetic wave B reflected by the interface between the dielectric layer 11 and the coating layer 13 are cancelled and attenuated by each other.

Alternatively, it is considered that attenuation occurs through the following mechanism. When electromagnetic waves are incident on the high-frequency antenna element 1, the interface between the coating layer 13 and the dielectric layer 11 hardly reflects the electromagnetic waves, since the permittivity of the coating layer 13 is higher than that of the dielectric layer 11. In other words, since the intensity of the electromagnetic wave B is small, the electromagnetic waves are reduced until reaching the receiving antenna unit. On the other hand, an electromagnetic wave entering from the coating layer 13 into the dielectric layer 11 is reflected by the interface between the dielectric layer 11 and the substrate 10, and reaches the dielectric layer 11 again. However, since the permittivity of the coating layer 13 is higher than that of the dielectric layer 11, most of the electromagnetic waves C are reflected, and reduced until entering the coating layer 13. The electromagnetic waves reflected between the coating layer 13 and the dielectric layer 11 and returning to the dielectric layer 11 similarly travel back and forth from the interface between the dielectric layer 11 and the substrate 10 to the interface between the coating layer 13 and the dielectric layer 11 (confinement effect). During the traveling, the electromagnetic waves are attenuated.

When the coating layer 13 is a film including epsilon-type iron oxide, a thickness of the coating layer 13 in a portion covering the dielectric layer 11 is not particularly limited without impairing the objective of the present invention. From the viewpoint of downsizing the high-frequency antenna element 1, the thickness of the coating layer 13 in a portion covering the dielectric layer 11 is preferably less than 3 mm, and more preferably at least 50 μm and less than 3 mm.

Note here that the thickness of the coating layer 13 that brings about an optimum electromagnetic wave absorbing effect may vary depending on the composition of materials composing the coating layer 13, as well as relative permittivity and relative magnetic permeability of the coating layer 13. In this case, it is preferable that an electromagnetic wave absorbing effect in the high-frequency antenna element 1 is optimized by finely adjusting the thickness of the coating layer 13.

Hereinafter, essential components and optional components of the coating layer 13, and a method for adjusting the relative permittivity and the relative magnetic permeability of the coating layer 13 are described for a case in which the coating layer 13 includes epsilon-type iron oxide and has the above-mentioned predetermined relative permittivity.

(Epsilon-Type Iron Oxide)

As the epsilon-type iron oxide, at least one selected from: $\varepsilon$-$Fe_2O_3$ crystal; and a crystal having a crystalline structure and a space group being the same as those of the $\varepsilon$-$Fe_2O_3$ crystal, in which a part of Fe sites in the $\varepsilon$-$Fe_2O_3$ crystal is substituted by an element M other than Fe, and being represented by a formula $\varepsilon$-$M_xFe_{2-x}O_3$, in which x is at least 0 and less than 2, is used. Since crystals of the epsilon-type iron oxide are magnetic crystals, such crystals may also be referred to as "magnetic crystals" herein.

Any known $\varepsilon$-$Fe_2O_3$ crystals can be used. The crystal having a crystalline structure and a space group being the same as those of the $\varepsilon$-$Fe_2O_3$ crystal, in which a part of Fe sites in the $\varepsilon$-$Fe_2O_3$ crystal is substituted by an element M other than Fe, the crystal being represented by a formula $\varepsilon$-$M_xFe_{2-x}O_3$, in which x is at least 0 and less than 2, is described later.

It should be noted that $\varepsilon$-$M_xFe_{2-x}O_3$, in which a part of Fe sites in the $\varepsilon$-$Fe_2O_3$ crystal is substituted by a substitution element M, is also referred to as "M-substituted $\varepsilon$-$Fe_2O_3$" herein.

A particle size of a particle having $\varepsilon$-$Fe_2O_3$ crystal and/or M-substituted $\varepsilon$-$Fe_2O_3$ crystal in magnetic phase is not particularly limited without interfering with the objective of the present invention. For example, an average particle size, as measured from a TEM (transmission electron microscope) photograph, of a particle having a magnetic crystal of epsilon-type iron oxide in magnetic phase, which is manufactured by way of a method to be described later, is within a range of 5 to 200 nm.

Furthermore, variation coefficient (standard deviation of particle size/average particle size) of the particles having magnetic crystal of epsilon-type iron oxide in the magnetic phase being manufactured by way of the method to be described later is within a range of less than 80%, which means that the particles are relatively fine and uniform in particle size.

The preferable coating layer 13 uses powder of such magnetic particles of epsilon-type iron oxide (in other words, particle having $\varepsilon$-$Fe_2O_3$ crystal and/or M-substituted $\varepsilon$-$Fe_2O_3$ crystal in magnetic phase) as the electromagnetic wave absorbing material in the coating layer 13. As used herein, the "magnetic phase" is a part of the powder that carries magnetic property.

"Having $\varepsilon$-$Fe_2O_3$ crystal and/or M-substituted $\varepsilon$-$Fe_2O_3$ crystal in magnetic phase" means that the magnetic phase is composed of $\varepsilon$-$Fe_2O_3$ crystals and/or M-substituted $\varepsilon$-$Fe_2O_3$ crystal, and includes a case in which impurity magnetic crystals, which are inevitable in manufacturing, are mixed into the magnetic phase.

Magnetic crystals of epsilon-type iron oxide may include impurity crystals of iron oxide having a space group different from that of $\varepsilon$-$Fe_2O_3$ crystals (specifically, $\alpha$-$Fe_2O_3$, $\gamma$-$Fe_2O_3$, FeO, and $Fe_3O_4$, as well as these crystals in which a part of Fe is substituted by other element).

In a case in which magnetic crystals of epsilon-type iron oxide include impurity crystals, a main phase is preferably magnetic crystals of $\varepsilon$-$Fe_2O_3$ and/or M-substituted $\varepsilon$-$Fe_2O_3$. In other words, in magnetic crystals of epsilon-type iron oxide composing the present electromagnetic wave absorbing material, a ratio of magnetic crystals of $\varepsilon$-$Fe_2O_3$ and/or M-substituted $\varepsilon$-$Fe_2O_3$ is preferably at least 50 mol % in a molar ratio as a compound.

An abundance ratio of crystals can be obtained by analysis through the Rietveld method based on X-ray diffraction pattern. Non-magnetic compounds generated in the sol-gel process such as silica ($SiO_2$) may be attached around the magnetic phase.

(M-Substituted $\varepsilon$-$Fe_2O_3$)

As long as the M-substituted $\varepsilon$-$Fe_2O_3$ satisfies the condition that the crystalline structure and space group are the same as those of the $\varepsilon$-$Fe_2O_3$ crystal, and that a part of Fe sites in the $\varepsilon$-$Fe_2O_3$ crystal is substituted by an element M other than Fe, a type of the element M in the M-substituted $\varepsilon$-$Fe_2O_3$ is not particularly limited. The M-substituted $\varepsilon$-$Fe_2O_3$ may include a plurality of types of element M other than Fe.

Preferred examples of the element M include In, Ga, Al, Sc, Cr, Sm, Yb, Ce, Ru, Rh, Ti, Co, Ni, Mn, Zn, Zr and Y. Among these, In, Ga, Al and Rh are preferable. In a case in which M is Al, in a composition represented by $\varepsilon$-$M_xFe_{2-x}O_3$, x is preferably within a range of, for example, at least 0 and less than 0.8. In a case in which M is Ga, x is preferably within a range of, for example, at least 0 and less than 0.8. In a case in which M is In, x is preferably within a range of, for example, at least 0 and less than 0.3. In a case in which M is Rh, x is preferably within a range of, for example, at least 0 and less than 0.3.

When the coating layer 13 including the above-described epsilon-type iron oxide is employed, there is provided a high-frequency antenna element 1 having a peak, at which the electromagnetic wave absorption is maximum within a band of, for example, 60 to 270 GHz, preferably within a band of 60 to 230 GHz. The frequency of maximum electromagnetic wave absorption can be adjusted by adjusting at least one of the type and the substitution amount of the element M in the M-substituted $\varepsilon$-$Fe_2O_3$.

Such an M-substituted $\varepsilon$-$Fe_2O_3$ magnetic crystal can be synthesized by a combined process of the reverse micelle method and the sol-gel method described later, as well as a calcination process. M-substituted $\varepsilon$-$Fe_2O_3$ magnetic crystal can also be synthesized by a combined process of the direct synthesis method and the sol-gel method as disclosed in Japanese Unexamined Patent Application Publication No. 2008-174405, as well as a calcination process.

Specifically, M-substituted $\varepsilon$-$Fe_2O_3$ magnetic crystal can be obtained by a combined process of the reverse micelle method and the sol-gel method, as disclosed in Jian Jin, Shinichi Ohkoshi and Kazuhito Hashimoto, ADVANCED MATERIALS 2004, 16, No. 1, January 5, pp. 48-51;

Shin-ichi Ohkoshi, Shunsuke Sakurai, Jian Jin, Kazuhito Hashimoto, JOURNAL OF APPLIED PHYSICS, 97, 10K312 (2005);

Shunsuke Sakurai, Jian Jin, Kazuhito Hashimoto and Shinichi Ohkoshi, JOURNAL OF THE PHYSICAL SOCIETY OF JAPAN, Vol. 74, No. 7, July, 2005, pp. 1946-1949;

Asuka Namai, Shunsuke Sakurai, Makoto Nakajima, Tohru Suemoto, Kazuyuki Matsumoto, Masahiro Goto, Shinya Sasaki, and Shinichi Ohkoshi, Journal of the American Chemical Society, Vol. 131, pp. 1170-1173, 2009; and the like.

In the reverse micelle method, two types of micellar solution containing surfactant, i.e. micellar solution I (raw material micelle) and micellar solution II (neutralizer micelle), are blended, thereby causing precipitation reaction of ferric hydroxide in the micelle. Thereafter, ferric hydroxide particulates generated in the micelle are subjected to silica coating, by the sol-gel method. The ferric hydroxide particulates with a silica coating layer are separated from liquid and then subjected to heat treatment in an atmospheric environment at a predetermined temperature (within a range of 700 to 1300° C.). This heat treatment creates particulates of $\varepsilon$-$Fe_2O_3$ crystal.

More specifically, M-substituted $\varepsilon$-$Fe_2O_3$ magnetic crystal is manufactured, for example, as follows.

First, in an aqueous phase of the micellar solution I with an oil phase being n-octane: iron (III) nitrate as an iron source; M nitrate as an M element source for substituting a part of iron (in the case of Al, aluminum (III) nitrate nonahydrate; in the case of Ga, gallium (III) nitrate n-hydrate; and in the case of In, indium (III) nitrate trihydrate); and a surfactant (e.g., cetyltrimethylammonium bromide) are dissolved.

An appropriate amount of nitrate of alkali earth metal (Ba, Sr, Ca, etc.) can be dissolved in advance in the aqueous phase of the micellar solution I. The nitrate functions as a shape controlling agent. Under the presence of alkali earth metal in the solution, rod-shaped particles of M-substituted $\varepsilon$-$Fe_2O_3$ magnetic crystal are finally obtained. Without any shape controlling agent, near-spherical particles of M-substituted $\varepsilon$-$Fe_2O_3$ magnetic crystal are obtained.

The alkali earth metal added as the shape controlling agent may remain on a surface portion of M-substituted $\varepsilon$-$Fe_2O_3$ magnetic crystal being generated. A mass of the alkali earth metal in M-substituted $\varepsilon$-$Fe_2O_3$ magnetic crystal is preferably no greater than 20% by mass and more preferably no greater than 10% by mass with respect to a total mass of the substituting element M and Fe in M-substituted $\varepsilon$-$Fe_2O_3$ magnetic crystal.

Ammonia aqueous solution is used as an aqueous phase of the micellar solution II with an oil phase being n-octane.

After blending the micellar solution I and the micellar solution II, the sol-gel method is applied. That is, stirring is continued during dropwise addition of silane (e.g., tetraethyl orthosilane) to the micellar solution mixture, thereby causing formation reaction of iron hydroxide or iron hydroxide containing element M in a micelle. As a result, a surface of deposited particulates of iron hydroxide generated in the micelle is coated with silica generated by hydrolysis of the silane.

Thereafter, particle powder obtained by separating from liquid, washing, and then drying the silica-coated M element-containing iron hydroxide particles is fed into a furnace, and subjected to heat treatment (calcination) in air within a temperature range of 700 to 1300° C., preferably 900 to 1200° C., and more preferably 950 to 1150° C.

The heat treatment causes an oxidation reaction in the silica coating, thereby changing the particulates of M element-containing iron hydroxide into particulates of M-substituted $\varepsilon$-$Fe_2O_3$.

Upon this oxidation reaction, the silica coating contributes to generation of M-substituted $\varepsilon$-$Fe_2O_3$ crystal having the same space group as $\varepsilon$-$Fe_2O_3$, instead of $\alpha$-$Fe_2O_3$ or $\gamma$-$Fe_2O_3$ crystal, and has also an effect of preventing sintering of particles. In addition, an appropriate amount of alkali earth metal promotes growth of the particles in a rod-like shape.

In addition, as described above, M-substituted $\varepsilon$-$Fe_2O_3$ magnetic crystal can be synthesized more economically and advantageously by a combined process of the direct synthesis method and the sol-gel method as disclosed in Japanese Unexamined Patent Application Publication No. 2008-174405, as well as a calcination process.

In brief, by firstly adding a neutralizer such as ammonia aqueous solution to an aqueous solvent in which trivalent iron salt and salt of the substitution element M (Ga, Al, etc.) are dissolved while stirring, a precursor composed of iron hydroxide (which may have been partially substituted by other element) is formed.

Thereafter, the sol-gel method is applied thereto, thereby forming a coating layer of silica on a surface of precursor particles. After being separated from the liquid, the silica-coated particles are subjected to the heat treatment (calcination) at a predetermined temperature, thereby obtaining particulates of M-substituted $\varepsilon$-$Fe_2O_3$ magnetic crystal.

In the above described synthesis of M-substituted $\varepsilon$-$Fe_2O_3$, iron oxide crystal (impurity crystal) having a space group different from that of $\varepsilon$-$Fe_2O_3$ crystal may be generated. Most common examples of polymorphism, which has a composition of $Fe_2O_3$ with different crystal structures, are $\alpha$-$Fe_2O_3$ and $\gamma$-$Fe_2O_3$. Other iron oxides include FeO and $Fe_3O_4$.

Presence of such impurity crystals is not preferable in terms of maximizing the characteristics of M-substituted $\varepsilon$-$Fe_2O_3$ crystal, but is acceptable without interfering with the effect of the present invention.

In addition, a coercive force $H_c$ of M-substituted $\varepsilon$-$Fe_2O_3$ magnetic crystal varies depending on the amount substituted by the substitution element M. In other words, by adjusting the substitution amount by the substitution element M in M-substituted $\varepsilon$-$Fe_2O_3$ magnetic crystal, the coercive force $H_c$ of M-substituted $\varepsilon$-$Fe_2O_3$ magnetic crystal can be adjusted.

More specifically, in a case in which Al, Ga, or the like is used as the substitution element M, a greater substitution amount results in a lower coercive force $H_c$ of M-substituted $\varepsilon$-$Fe_2O_3$ magnetic crystal. In contrast, in a case in which Rh or the like is used as the substitution element M, a greater substitution amount results in a greater coercive force $H_c$ of M-substituted $\varepsilon$-$Fe_2O_3$ magnetic crystal.

Ga, Al, In, and Rh are preferred as the substitution element M from the viewpoint of easy adjustment of the coercive force $H_c$ of M-substituted $\varepsilon$-$Fe_2O_3$ magnetic crystal in accordance with the substitution amount by the substitution element M.

Along with the lowering of the coercive force $H_c$, a peak frequency, at which electromagnetic wave absorption by epsilon-type iron oxide is maximum, moves toward a lower frequency side or a higher frequency side. That is, a peak frequency of electromagnetic wave absorption can be controlled by the substitution amount by the substitution element M.

In a case of commonly used electromagnetic wave absorbers, the absorption amount becomes almost zero if an incident angle or frequency of electromagnetic wave is out of an expected range. In contrast, in a case of using epsilon-type iron oxide, even if those values are slightly out of expected ranges, electromagnetic wave absorption is exhibited within a broad range of frequency bands and electromagnetic wave incident angles. Given this, the present invention can provide an electromagnetic wave absorber that can absorb electromagnetic waves within a broad frequency band.

Particle size of the epsilon-type iron oxide can be controlled by adjusting the temperature of the heat treatment (calcination) in the above described process.

According to the combined process of the reverse micelle method and the sol-gel method, or the combined process of the direct synthesis method and the sol-gel method as disclosed in Japanese Unexamined Patent Application Publication No. 2008-174405, particles of epsilon-type iron oxide can be synthesized, which has a particle size within a range of 5 to 200 nm as an average particle size measured from a TEM (transmission electron microscope) photograph. The average particle size of epsilon-type iron oxide is preferably at least 10 nm and more preferably at least 20 nm.

When calculating an average particle size as a number average particle size, if the particle of epsilon-type iron oxide is rod-shaped, a diameter in a longitudinal direction of the particle observed in a TEM photograph is considered to be a diameter of the particle. The number of particles counted for calculating the average particle size is required to be sufficiently large but not particularly limited; however, preferably at least 300.

In addition, the silica that coats the surface of iron hydroxide particulates in the sol-gel method may remain on the surface of M-substituted $\varepsilon$-$Fe_2O_3$ magnetic crystal after the heat treatment (calcination). Presence of non-magnetic compound such as silica on a crystal surface is preferable for improving handleability, durability, and weather resistance of the magnetic crystal.

Preferable examples of non-magnetic compounds other than silica include heat resistant compounds such as alumina and zirconia.

However, an excessive amount of a non-magnetic compound attached may cause heavy agglutination of particles and is therefore not preferable.

In a case in which the non-magnetic compound is silica, a mass of Si in M-substituted $\varepsilon$-$Fe_2O_3$ magnetic crystal is preferably no greater than 100% by mass with respect to a total mass of the substituting element M and Fe in M-substituted $\varepsilon$-$Fe_2O_3$ magnetic crystal.

A part or a large part of silica attached to M-substituted $\varepsilon$-$Fe_2O_3$ magnetic crystal can be removed by a method of immersion in an alkaline solution. The amount of silica attached can thus be adjusted to a desired amount.

The content of epsilon-type iron oxide in the material composing the coating layer 13 is not particularly limited without interfering with the objective of the present invention. The content of epsilon-type iron oxide is typically preferably at least 30% by mass, more preferably at least 40% by mass, particularly preferably at least 60% by mass, and most preferably 60 to 91% by mass with respect to a mass of the material composing the electromagnetic wave absorbing film.

(Relative Permittivity Adjustment Method)

Relative permittivity of the coating layer 13 including epsilon-type iron oxide is 6.5 to 65, preferably 10 to 50, and more preferably 15 to 30. A method of adjusting relative permittivity of the coating layer 13 is not particularly limited. Examples of a method of adjusting relative permittivity of the coating layer 13 may include a method of adding dielectric powder to the coating layer 13 while adjusting the content of the dielectric powder.

Preferred examples of the dielectric substances include a barium titanate, strontium titanate, calcium titanate, magnesium titanate, bismuth titanate, zirconium titanate, zinc titanate, and titanium dioxide. The coating layer 13 can include a combination of multiple types of dielectric powder.

The particle size of the dielectric powder used for adjusting relative permittivity of the coating layer 13 is not particularly limited without interfering with the objective of the present invention. The average particle size of the dielectric powder is preferably 1 to 100 nm, and more preferably 5 to 50 nm. The average particle size of the dielectric powder is number average particle size of primary particles of the dielectric powder observed by an electron microscope.

In a case of adjusting relative permittivity of the coating layer 13 using the dielectric powder, the amount of the dielectric powder used is not particularly limited as long as the relative permittivity of the coating layer 13 is within a predetermined range. The amount of the used dielectric powder is typically preferably 0 to 20% by mass and more preferably 5 to 10% by mass with respect to a mass of a material composing the coating layer 13.

Alternatively, by adding a carbon nanotube to the coating layer 13, the relative permittivity of the coating layer 13 can be adjusted. From the viewpoint of easily obtaining the high-frequency antenna element 1 excellent in absorbing performance, it is preferable that the coating layer 13 contains carbon nanotube. The carbon nanotube may be used together with the above-described dielectric powder.

The amount of the carbon nanotube in the material composing the coating layer 13 is not particularly limited as long as the relative permittivity of the coating layer 13 is within the above-mentioned predetermined range. However, since the carbon nanotube is also a conductive material, an excessive amount of the carbon nanotube may deteriorate the electromagnetic wave absorbing properties provided by the coating layer 13.

Typically, the amount of the carbon nanotube used is preferably 0 to 20% by mass and more preferably 1 to 10% by mass with respect to a mass of the material composing the coating layer 13.

(Relative Magnetic Permeability Adjustment Method)

Relative magnetic permeability of the coating layer 13 is not particularly limited, but is preferably 1.0 to 1.5. A method of adjusting the relative magnetic permeability of the coating layer 13 is not particularly limited. Examples of a method of adjusting the relative magnetic permeability of the coating layer 13 may include a method of adjusting the substitution amount by the substitution element M in epsilon-type iron oxide as described above, and a method of adjusting a content of epsilon-type iron oxide in the coating layer 13.

(Polymer)

In order to facilitate formation of a coating layer 13 having a uniform thickness while epsilon-type iron oxide, etc. is uniformly dispersed in the coating layer 13, the coating layer 13 may contain a polymer. When the coating layer 13 contains a polymer, a component such as epsilon-type iron oxide can be easily dispersed in a matrix composed of the polymer. In a case in which the coating layer 13 is formed by using a film forming paste described later, film forming properties of the film forming paste are improved by including a polymer in the film forming paste.

The type of the polymer is not particularly limited without interfering with the objective of the present invention, as long as film formation of the coating layer 13 is allowed. The polymer may also be an elastic material such as an elastomer or a rubber. The polymer can be either a thermoplastic resin or a curing resin. In a case of a curing resin, the curing resin can be either a photosetting resin or a thermosetting resin.

Preferred examples of the polymer being the thermoplastic resin include polyacetal resin, polyamide resin, polycarbonate resin, polyester resin (polybutylene terephthalate, polyethylene terephthalate, polyarylate and the like), FR-AS resin, FR-ABS resin, AS resin, ABS resin, polyphenylene oxide resin, polyphenylene sulfide resin, polysulfone resin, polyethersulfone resin, polyetheretherketone resin, fluorine-based resin, polyimide resin, polyamideimide resin, polyamide bismaleimide resin, polyetherimide resin, polybenzooxazol resin, polybenzothiazol resin, polybenzimidazole resin, BT resin, polymethylpentene, ultra high molecular weight polyethylene, FR-polypropylene, cellulose resin, (meta)acrylic resin (polymethylmethacrylate and the like), polystyrene, and the like.

Preferred examples of the polymer being the thermosetting resin include phenolic resin, melamine resin, epoxy resin, alkyd resin, and the like. As the photosetting resin, a resin obtained by photosetting of various vinyl monomers or various monomers having an unsaturated bond such as (meth)acrylic ester can be used.

Preferred examples of the polymer being the elastic material include olefin-based elastomer, styrene-based elastomer, polyamide-based elastomer, polyester-based elastomer, polyurethane-based elastomer, and the like.

In a case in which the coating layer 13 is formed by using the film forming paste described later, the film forming paste can include a dispersion medium and the polymer. In this case, from the viewpoints of applicability of the paste and easy uniform dispersion of the epsilon-type iron oxide in the polymer, it is preferable that the polymer is soluble in the dispersion medium.

In a case in which the material composing the coating layer 13 contains the polymer, the amount of the polymer is not particularly limited without interfering with the objective of the present invention. Typically, the content of the polymer is preferably 5 to 30% by mass and more preferably 10 to 25% by mass with respect to a mass of the material composing the coating layer 13.

(Dispersant)

In order to favorably disperse epsilon-type iron oxide and substances added for adjusting relative permittivity and relative magnetic permeability in the film, the coating layer 13 can contain a dispersant. A method of blending the dispersant into the material composing the coating layer 13 is not particularly limited. The dispersant can be blended uniformly along with the epsilon-type iron oxide and the polymer. When materials composing the coating layer 13 include a polymer, the dispersant may be blended in the polymer. Alternatively, the epsilon-type iron oxide and the substances added for adjusting relative permittivity and relative magnetic permeability that are treated with the dispersant in advance can be blended into the material composing the coating layer 13.

The type of the dispersant is not particularly limited without interfering with the objective of the present invention. The dispersant can be selected from various dispersants conventionally used for dispersion of various inorganic particulates and organic particulates.

Preferred examples of the dispersant include a silane coupling agent, a titanate coupling agent, a zirconate coupling agent, an aluminate coupling agent, and the like.

The content of the dispersant is not particularly limited without interfering with the objective of the present invention. The content of the dispersant is preferably 0.1 to 30% by mass, more preferably 1 to 15% by mass, and particularly preferably 1 to 10% by mass with respect to a mass of the material composing the coating layer 13.

(Other Components)

The material composing the coating layer 13 including epsilon-type iron oxide may include various additives without interfering with the objective of the present invention. The additives that may be contained in the material composing the coating layer 13 include a coloring agent, an antioxidant, a UV absorber, a fire retardant, a fire retardant aid, a plasticizer, a surfactant, and the like. These additives are used without interfering with the objective of the present invention, taking into consideration conventionally used amounts thereof.

When the substrate 10, the dielectric layer 11, the receiving antenna unit 12, and the coating layer 13 are combined with each other as described above, the high-frequency antenna element 1 is formed.

(Film Forming Paste)

It is preferable that the coating layer 13 is formed by applying a film forming paste including epsilon-type iron oxide onto surfaces of the dielectric layer 11 and the receiving antenna unit 12.

The film forming paste contains the epsilon-type iron oxide described above with regard to the coating layer 13. The film forming paste may contain the substances added for adjusting the relative permittivity and relative magnetic permeability, the polymer, and other components described above with regard to the coating layer 13. When the polymer is a curing resin, the film forming paste contains a compound which is a precursor of the curing resin. In this case, the film forming paste contains a curing agent, a curing promoter, a polymerization initiator, etc. as necessary.

Composition of the film forming paste is determined such that the relative permittivity of the coating layer 13 that is formed by using the paste and contains epsilon-type iron oxide is within the predetermined range mentioned above.

The film forming paste generally contains a dispersion medium. However, the dispersion medium is not necessary if the film forming paste contains a liquid precursor of a curing resin such as a liquid epoxy compound.

As the dispersion medium, water, an organic solvent, and an aqueous solution of organic solvent can be used. As the dispersion medium, an organic solvent is preferable, since an organic solvent can easily dissolve organic components and has low latent heat of vaporization allowing easy removal by drying.

Preferred examples of an organic solvent used as the dispersion medium include: ketones such as diethyl ketone, methylbutyl ketone, dipropylketone, and cyclohexanone; alcohols such as n-pentanol, 4-methyl-2-pentanol, cyclohexanol, and diacetone alcohol; ether-based alcohols such as ethylene glycol monomethyl ether, ethylene glycol monoethyl ether, ethylene glycol monobutyl ether, propylene glycol monomethyl ether, propylene glycol monoethyl ether, diethylene glycol monomethyl ether, diethylene glycol monoethyl ether, diethylene glycol dimethyl ether, and diethylene glycol diethyl ether; saturated aliphatic monocarboxylate alkyl esters such as n-butyl acetate, and amyl acetate; lactate esters such as ethyl lactate, and n-butyl lactate; and ether-based esters such as methylcellosolve acetate, ethylcellosolve acetate, propylene glycol monomethyl ether acetate, propylene glycol monoethyl ether acetate, ethyl-3-ethoxypropionate, 2-methoxybutyl acetate, 3-methoxybutyl acetate, 4-methoxybutyl acetate, 2-methyl-3-methoxybutyl acetate, 3-methyl-3-methoxybutyl acetate, 3-ethyl-3-methoxybutyl acetate, 2-ethoxybutyl acetate, 4-ethoxybutyl acetate, 4-propoxybutyl acetate, and 2-methoxypentyl acetate. These may be used singly or in combination of two or more.

Solid content concentration of the film forming paste is appropriately adjusted in accordance with the method of applying the film forming paste or the thickness of the electromagnetic wave absorbing film. Typically, the solid content concentration of the film forming paste is preferably 3 to 60% by mass and more preferably 10 to 50% by mass. The solid content concentration of the paste is calculated by considering a total of a mass of component not dissolved in the dispersion medium and a mass of component dissolved in the dispersion medium as a solid content mass.

<<High-Frequency Antenna Module>>

A high-frequency antenna module is not particularly limited, as long as the high-frequency antenna module includes the above-described high-frequency antenna element.

For example, the high-frequency antenna module includes various members that can be mounted on generally used antenna modules, such as an amplifier, a filter, a signal processing unit, a power unit, a transmitting antenna portion, and a connection terminal.

These members are disposed and connected inside the antenna module in accordance with a design of a well-known and commonly used antenna module.

EXAMPLES

Although Examples of the present invention will be described hereafter to explain the present invention in further detail, the present invention is not limited by the Examples below.

Example 1

A 127 μm-thick polytetrafluoroethylene resin as a dielectric layer was provided on a metal substrate, and a 125 μm-thick coating layer was formed on the dielectric layer to form a laminated product.

The coating layer was obtained as follows. Resin, a dispersant, epsilon-type iron oxide, and a carbon nanotube (CNT) were added to terpineol according to the following compositions, and these components were uniformly dissolved or dispersed to obtain the film forming paste; and the resulting film forming paste was applied onto the dielectric layer, followed by removing a solvent. The solid content concentration of the film forming paste was adjusted to 40% by mass.

<Composition of Coating Layer>

Resin (cellulose (methylcellulose)): 11.5% by mass

Dispersant (a 1:1 mixture (mass ratio) of di(isopropyloxy) di(isostearoyloxy) titanium and vinyl trimethoxysilane): 7.6% by mass ε-$Ga_xFe_{2-x}O_3$ (x≈0.45) (average particle size: 20 to 30 nm): 77.9% by mass Multi-walled carbon nanotube (major axis: 150 nm): 3.0% by mass With regard to the composition of the above-mentioned coating layer, an amount of attenuation of electromagnetic waves reflected from the surface of the coating layer when electromagnetic waves were incident was calculated by a transmission theory.

The input impedance in the dielectric layer was calculated by the following formula.

[Formula 1]

$$Z_1 = \sqrt{\frac{\mu_r(\text{Dielectric substance})}{\varepsilon_r(\text{Dielectric substance})}} \tanh\left(\frac{-j2\pi fd(\text{Dielectric substance})}{c\sqrt{\varepsilon_r(\text{Dielectric substance})\mu_r(\text{Dielectric substance})}}\right)$$

In this formula, j denotes an imaginary unit, f denotes a frequency, d (dielectric substance) denotes a thickness of the dielectric layer (=127 μm), and c denotes speed of light. As the relative permittivity ($\varepsilon_r$ (dielectric substance)) of polytetrafluoroethylene resin, a known value was used.

Furthermore, the relative magnetic permeability, $\mu_r$ (dielectric substance), was made to be 1 because of being a non-magnetic substance. Furthermore, the input impedance of the coating layer was calculated by the following formula.

[Formula 2]

$$Z_{in} = \sqrt{\frac{\mu_r(\text{Coating layer})}{\varepsilon_r(\text{Coating layer})}} \frac{Z_1 + \sqrt{\frac{\mu_r(\text{Coating layer})}{\varepsilon_r(\text{Coating layer})}} \tanh\left(\frac{-j2\pi fd(\text{Coating layer})}{c\sqrt{\varepsilon_r(\text{Coating layer})\mu_r(\text{Coating layer})}}\right)}{\sqrt{\frac{\mu_r(\text{Coating layer})}{\varepsilon_r(\text{Coating layer})}} + Z_1 \tanh\left(\frac{-j2\pi fd(\text{Coating layer})}{c\sqrt{\varepsilon_r(\text{Coating layer})\mu_r(\text{Coating layer})}}\right)}$$

In this formula, d (coating layer) denotes a thickness of the dielectric layer (=125 μm). As the relative permittivity ($\varepsilon_r$ (coating layer)) and the relative magnetic permeability ($\mu_r$ (dielectric substance)) of the coating layer, values calculated from the relative permittivity and the relative magnetic permeability of the components measured by the free space method using the vector network analyzer were used.

Return loss (RL) was calculated from the following formula.

$$RL = 20\log\left|\frac{Z_{in}-1}{Z_{in}+1}\right| \quad \text{[Formula 3]}$$

Figure 5:
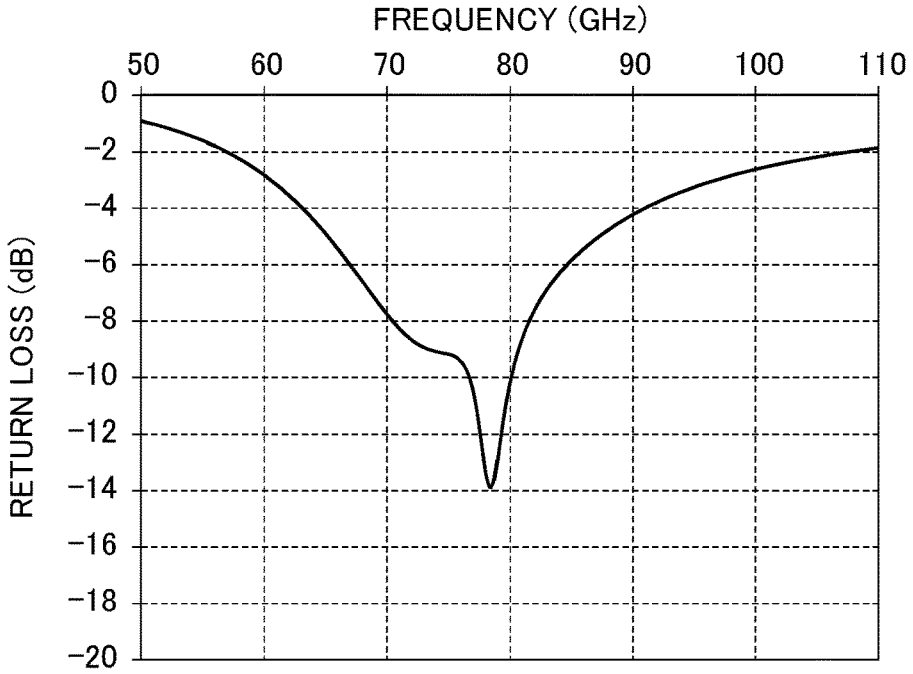
FIG. 5 is a graph showing frequency dependence of return loss with respect to a laminated product of Example 1.

FIG. 5 shows frequency dependence of the calculated return loss. It was clarified that return loss higher than −10 dB was able to be achieved.

Example 2

A 127 μm-thick polytetrafluoroethylene resin as a dielectric layer was provided on a metal substrate, and a 97 μm-thick coating layer was formed on the dielectric layer to form a laminated product.

The coating layer was obtained as follows. Resin, a dispersant, epsilon-type iron oxide, and a carbon nanotube (CNT) were added to terpineol according to the following compositions, and these components were uniformly dissolved or dispersed to obtain the film forming paste; and the resulting film forming paste was applied onto the dielectric layer, followed by removing a solvent. The solid content concentration of the film forming paste was adjusted to 40% by mass.

<Composition of Coating Layer>

Resin (cellulose (methylcellulose)): 11.5% by mass

Dispersant (a 1:1 mixture (mass ratio) of di(isopropyloxy) di(isostearoyloxy) titanium and vinyl trimethoxysilane): 5.9% by mass ε-$Ga_xFe_{2-x}O_3$(x≈0.45) (average particle size: 20 to 30 nm): 77.9% by mass Multi-walled carbon nanotube (major axis: 150 nm): 4.7% by mass With regard to the composition of the coating layer, an amount of attenuation of electromagnetic waves reflected from the surface of the coating layer when electromagnetic waves were incident was calculated in the same manner as in Example 2.

The relative permittivity of polytetrafluoroethylene resin, as well as the relative permittivity and the relative magnetic permeability of the coating layer, were obtained from the relative permittivity and the relative magnetic permeability of the component measured by the free space method using the vector network analyzer.

Figure 6:
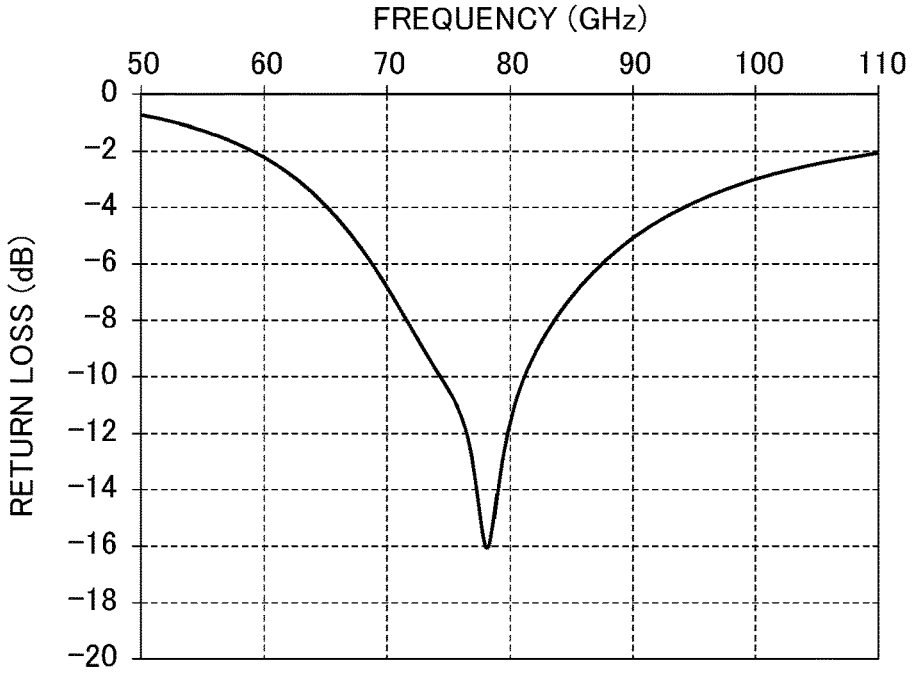
FIG. 6 is a graph showing frequency dependence of return loss with respect to a laminated product of Example 2.

As shown in FIG. 6, it was clarified that high return loss higher than −10 dB was able to be achieved.

EXPLANATION OF REFERENCE NUMERALS

1 high-frequency antenna element
10 substrate
11 dielectric layer
12 receiving antenna unit
13 coating layer

What is claimed is:

1. A high-frequency antenna element comprising a substrate, a dielectric layer, a receiving antenna unit, and a coating layer, wherein:

the dielectric layer is laminated on the substrate;

the receiving antenna unit is mounted on the dielectric layer;

the coating layer covers a surface of the dielectric layer in a portion in which the receiving antenna unit is not mounted while the coating layer is in contact with entire side surfaces of the receiving antenna unit, and the coating layer covers at least a part of an upper surface of the receiving antenna unit; and the coating layer is a film capable of imparting electromagnetic wave absorbing properties to the high-frequency antenna element.

2. The high-frequency antenna element according to claim 1, wherein a coating layer covers an entire surface of the upper surface of the receiving antenna unit.

3. The high-frequency antenna element according to claim 1, wherein the coating layer comprises epsilon-type iron oxide, wherein the epsilon-type iron oxide is at least one selected from an ε-$Fe_2O_3$ crystal and a crystal having a crystalline structure and a space group identical to a crystalline structure and a space group of the ε-$Fe_2O_3$ crystal, in which a part of Fe sites in the ε-$Fe_2O_3$ crystal is substituted by an element M other than Fe, and is represented by a formula ε-$M_xFe_{2-x}O_3$, wherein x is at least 0 and less than 2; and a relative permittivity of the coating layer is 6.5 to 65.

4. The high-frequency antenna element according to claim 1, wherein the coating layer includes a carbon nanotube.

5. A high-frequency antenna module comprising a module assembly comprising the high-frequency antenna element according to claim 1.

* * * * *